US011660510B2

(12) United States Patent
McLachlin

(10) Patent No.: US 11,660,510 B2
(45) **Date of Patent: *May 30, 2023**

(54) ALIGNMENT AID FOR GOLF CLUB

(71) Applicant: ShortGameChef, LLC, Scottsdale, AZ (US)

(72) Inventor: Parker McLachlin, Scottsdale, AZ (US)

(73) Assignee: ShortGameChef, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/721,490

(22) Filed: Apr. 15, 2022

(65) Prior Publication Data

US 2022/0233922 A1 Jul. 28, 2022

Related U.S. Application Data

(63) Continuation of application No. 17/243,693, filed on Apr. 29, 2021, now Pat. No. 11,331,543.

(60) Provisional application No. 63/031,908, filed on May 29, 2020, provisional application No. 63/019,651, filed on May 4, 2020.

(51) Int. Cl.
*A63B 53/04* (2015.01)
*A63B 69/36* (2006.01)

(52) U.S. Cl.
CPC ..... *A63B 53/0441* (2020.08); *A63B 69/3632* (2013.01); *A63B 2214/00* (2020.08)

(58) Field of Classification Search
CPC ..... A63B 53/0441; A63B 69/3632; A63B 2214/00; A63B 60/52; A63B 2071/0694; A63B 53/02
USPC ..... 473/219–256, 305–315, 324, 409
See application file for complete search history.

(56) References Cited

U.S. PATENT DOCUMENTS 1,603,850 A 10/1926 Keating
2,027,452 A 1/1936 Rusing
2,219,670 A * 10/1940 Wettlaufer ..... A63B 53/06 473/247
2,784,969 A 3/1957 Brandon
2,820,638 A 1/1958 Morrison
(Continued)

FOREIGN PATENT DOCUMENTS

WO 2021225854 A1 11/2021

OTHER PUBLICATIONS

"DST Compressor 8 Iron." DST Golf, shop.dstgolf.com/our-golf-clubs/dst-compressor-8-iron/. Accessed Apr. 29, 2020.
(Continued)

*Primary Examiner* — Nini F Legesse
(74) *Attorney, Agent, or Firm* — Carlson, Gaskey & Olds, P.C.

(57) ABSTRACT

This disclosure relates to an alignment aid for a golf club. The alignment aid provides a golf club with one or more markings on or adjacent the hosel of the golf club, and can be used by the golfer to achieve a proper alignment. In particular, the alignment aid may include at least two markings, each of which can be used by the golfer to assist the golfer in achieving the proper alignment corresponding to a desired type of golf shot. As an example, the golfer may use one marking to achieve a proper alignment for a pitch shot, and the golfer may use another marking to achieve a proper alignment for a bunker shot.

20 Claims, 11 Drawing Sheets

(56) References Cited

U.S. PATENT DOCUMENTS

| | | | | |
|---|---|---|---|---|
| 4,222,567 | A | 9/1980 | Shabala | |
| 4,993,710 | A | 2/1991 | Marshall | |
| 5,158,297 | A | 10/1992 | Johnson | |
| 5,228,689 | A | 7/1993 | Donofrio, Sr. | |
| 5,385,346 | A | 1/1995 | Carroll et al. | |
| 7,172,513 | B1 | 2/2007 | Rinker | |
| 7,976,399 | B1 * | 7/2011 | Pritchett | A63B 69/3632 473/238 |
| 8,241,138 | B2 | 8/2012 | Maglaque et al. | |
| 8,870,674 | B1 | 10/2014 | Abbott | |
| 9,962,581 | B2 * | 5/2018 | Cordle | A63B 69/3685 |
| 11,331,543 | B2 * | 5/2022 | McLachlin | A63B 53/02 |
| 2002/0160849 | A1 * | 10/2002 | Thomas | A63B 60/02 473/226 |
| 2010/0144457 | A1 | 6/2010 | Kim | |
| 2010/0261542 | A1 | 10/2010 | Maglaque et al. | |
| 2012/0231896 | A1 | 9/2012 | Seluga et al. | |
| 2014/0315653 | A1 | 10/2014 | Wong | |
| 2022/0233922 | A1 | 7/2022 | McLachlin | |

OTHER PUBLICATIONS

"Impact Press: Golf Club & Training Aid: Www.impactpressgolf.com." Impact Press Golf, impactpressgolf.com/Accessed Apr. 29, 2020.

International Search Report and Written Opinion for International Application No. PCT/US2021/029796 dated Aug. 12, 2021.

Request for Ex Parte Reexamination for Patent No. 11,331,543 filed May 22, 2023.

Information Disclosure by Applicant—DST Reexam.

Second Information Disclosure by Applicant—DST Reexam.

Delayed Strike Technologies; Reexamination—Third Party Requester Power of Attorney for U.S. Pat. No. 11,331,543.

Request for Ex Parte Reexamination of U.S. Pat. No. 11,331,543 Pursuant To 35 U.S.C. § 302 Et Seq. And 37 C.F.R. § 1.510, Et Seq.

Electronic Acknowledgement Receipt for U.S. Appl. No. 90/015,215 dated Mar. 22, 2023.

Ex1003. File History for U.S. Appl. No. 63/019,651.

Ex1004. File History for U.S. Appl. No. 63/031,908.

Ex1006. British Patent Application No. GB1301254.7 filed Jan. 24, 2013.

Ex1007. Robert "Bertie" Cordle's Handwritten Notebook including figures.

Ex1013. Non-Final Office Action for U.S. Appl. No. 17/721,490 dated Dec. 21, 2022.

Ex1015. Declaration of Robert "Bertie" Cordle for U.S. Pat. No. 11,331,543.

Ex1016. Response to Non-Final Office Action for U.S. Appl. No. 17/721,490 dated Dec. 21, 2022.

Electronic Patent Application Fee Transmittal for Ex Parte Reexamination (1.510(A)) Non-Streamlined.

* cited by examiner

ALIGNMENT AID FOR GOLF CLUB

RELATED APPLICATIONS

This application is a continuation of prior U.S. application Ser. No. 17/243,693, filed Apr. 29, 2021. The '693 application claims the benefit of U.S. Provisional Application No. 63/019,651, filed May 4, 2020, and U.S. Provisional Application No. 63/031,908, filed May 29, 2020. The '693, '651, and '908 Applications are herein incorporated by reference in their entirety.

TECHNICAL FIELD

This disclosure relates to an alignment aid for a golf club and a corresponding method.

BACKGROUND

Golf is a sport in which a player uses various clubs to hit a golf ball into a series of holes on a course. Among other things, golfing requires selection of an appropriate golf club for the distance between the golf ball and the target area where the ball is to be hit, proper alignment, and a proper swing of the golf club. Alignment refers to the orientation and relative positioning of the golfer's body, the golf club, and the golf ball. Most commonly, the term alignment is used to refer to the golfer's alignment at setup, immediately before the golfer swings the golf club. The golfer's alignment influences the ability of the golfer to make a proper swing, make solid contact with the ball, direct the ball toward a target area, and achieve a desired ball flight.

SUMMARY

An alignment aid for a golf club according to an exemplary aspect of the present disclosure includes, among other things, a first marking on a hosel of the golf club configured for use by a golfer in achieving a first alignment, and a second marking on the hosel configured for use by the golfer in achieving a second alignment different than the first alignment, wherein, in both the first and second alignments, a club face of the golf club is square to a target.

In a further embodiment, the first marking extends along a first line parallel to a central axis of a shaft of the golf club and parallel to a leading edge of the golf club, and the second marking extends along a second line non-parallel to both the first marking and the central axis.

In a further embodiment, the second marking is inclined such that the second marking diverges gradually from the first marking in a rearward direction when moving along the hosel in a direction away from the club head.

In a further embodiment, the second marking is inclined rearward of the first marking by an angle within range between 5 and 15 degrees.

In a further embodiment, the alignment aid includes a third marking on the hosel configured for use by the golfer in achieving a third alignment different than the first and second alignments. In the third alignment, the club face is open to a target.

In a further embodiment, the third marking extends along a third line circumferentially spaced-apart from the first marking about the hosel in a forward direction, and the third line extends parallel to both the central axis and the first line.

In a further embodiment, the third marking is spaced-apart from the first marking by a circumferential arc length corresponding to an angle of rotation about the central axis within a range between 35 and 45 degrees.

In a further embodiment, the first alignment is conducive to hitting a pitch shot, the second alignment is conducive to hitting a chip shot, and the third alignment is conducive to hitting a bunker shot.

In a further embodiment, the alignment aid is applied to the golf club by machining the first and second markings into the golf club.

In a further embodiment, the first and second markings are provided by a first continuous line and a second continuous line, respectively.

In a further embodiment, the first and second markings are provided by a first set of marks and a second set of marks, respectively.

In a further embodiment, the golf club exhibits a non-zero bounce angle such that a leading edge of the golf club is spaced-apart above a ground surface when in at least one of the first and second alignments.

A further embodiment relates to a method of instructing a golfer to use a golf club including the alignment aid of claim 1.

A golf club according to an exemplary aspect of the present disclosure includes, among other things, a shaft having a central axis, a club head including a hosel and a club face. The club face includes a leading edge, and the shaft is connected to the club head via the hosel. The golf club further includes a grip attached to the shaft and located adjacent an end of the shaft generally opposite the club head. The hosel includes a first marking configured for use by a golfer in achieving a first alignment conducive to hitting a pitch shot, the hosel includes a second marking configured for use by the golfer in achieving a second alignment different than the first alignment and conducive to hitting a bunker shot, and the hosel includes a third marking configured for use by the golfer in achieving a third alignment different than the first, second, and third alignments and conducive to hitting a chip shot. When in the first and third alignments, the club face is square to a target and, when in the second alignment, the club face is open to the target. Further, the first marking extends along a first line parallel to the central axis and parallel to the leading edge. The second marking extends along a second line circumferentially spaced-apart from the first marking about the hosel in a forward direction, and the second line extends parallel to both the central axis and the first line. The third marking extends along a third line non-parallel to both the first marking and the central axis. Additionally, the third marking diverges gradually from the first marking in a rearward direction when moving along the hosel in a direction away from the club head. The first, second, and third markings are machined into the hosel, and the golf club exhibits a non-zero bounce angle such that a leading edge of the golf club is spaced-apart above a ground surface when in at least one of the first, second, and third alignments.

A method according to an exemplary aspect of the present disclosure includes, among other things, aligning a golf club relative to a golf ball, a target, and a golfer to achieve a first alignment in which a first plane normal to a ground surface passes through an entirety of a first marking on a hosel of the golf club, an entirety of a central axis of a shaft of the golf club, and either a nose or a center of a chest of the golfer. Further, in the first alignment, the golf club is either open or square to the target.

In a further embodiment, the method includes aligning the golf club relative to the golf ball, the target, and the golfer to achieve a second alignment in which a second plane normal to a ground surface passes through an entirety of a second marking on the hosel, an entirety of the central axis, and either the nose or the center of the chest of the golfer. Further, the second marking is circumferentially spaced-apart from the first marking about the hosel, an effective loft angle of the golf club in the first alignment is different than the effective loft angle of the golf club in the second alignment, and, in the second alignment, the golf club is either open or square to the target.

In a further embodiment, the method includes aligning the golf club relative to the golf ball, the target, and the golfer to achieve a third alignment in which a third plane passes through an entirety of a third marking on the hosel and either the nose or center of the chest of the golfer. Further, the third marking is non-parallel to the first marking, the third plane is transverse to the central axis. Additionally, in the third alignment, the effective loft of the golf club is less than in the first and second alignments, and, in the third alignment, the golf club is square to the target.

In a further embodiment, when in the first and second alignments, the golf ball is between a lead foot and a trail foot of the golfer, and, when in the third alignment, the golf ball is closer to the trail foot of the golfer than the lead foot.

In a further embodiment, the aligning step is performed with assistance from a golf instructor or an instructional guide.

In a further embodiment, the first marking corresponds to a setup position of a famous golfer such that, when in the first alignment, the alignment of the golfer mimics the setup position of the famous golfer.

DETAILED DESCRIPTION

This disclosure relates to an alignment aid for a golf club and a corresponding method. The alignment aid provides a golf club with one or more markings on or adjacent the hosel of the golf club, and can be used by the golfer to achieve a proper alignment. In particular, the alignment aid may include at least two markings, each of which can be used by the golfer to assist the golfer in achieving the proper alignment corresponding to a desired type of golf shot. As an example, the golfer may use one marking to achieve a proper alignment for a pitch shot, and the golfer may use another marking to achieve a proper alignment for a bunker shot. This disclosure provides a number of benefits which will be appreciated from the below description.

Figure 1:
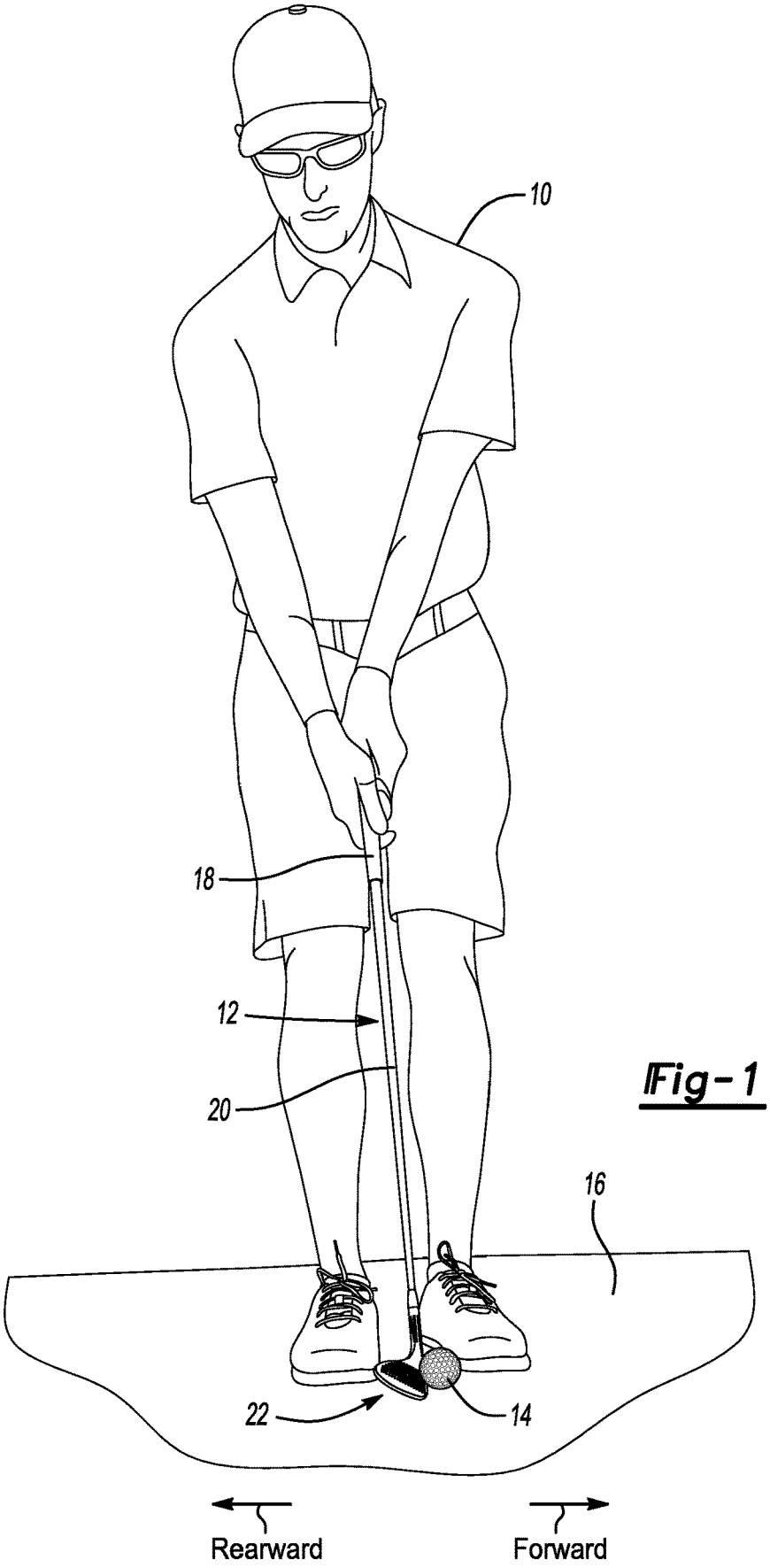
FIG. 1 is a face-on view (i.e., normal to the front of the golfer's body) of a golfer aligned relative to a golf ball.

FIG. 1 is a face-on view of a golfer 10 gripping a golf club 12. The golfer 10 is aligned relative to a golf ball 14, which lies on a ground surface 16, and is ready to swing the golf club 12 to hit the golf ball 14 toward a target area, such as a green, in a forward direction. The "forward" and "rearward" directions are labeled in some drawings for ease of reference. The ground surface 16 may be grass or sand, as examples.

A typical golf swing includes a backswing in which the golfer 10 moves the golf club 12 rearwardly, a transition when the golfer 10 changes the direction of travel of the golf club 12 from rearward to forward near the end of the backswing, a downswing when the golfer 10 moves the golf club 12 forward toward the golf ball 14, impact when the golf club 12 strikes the golf ball 14, and a follow through where the golfer 10 swings the golf club 12 through the ball and to a finish position. In this disclosure, the term alignment is used to refer to the orientation and relative positioning, before beginning the golf swing (i.e., at setup), of the body of the golfer 10, the golf club 12, and the golf ball 14. Alignment has an influence on the ability of the golfer 10 to make a proper, or desired, swing, make solid contact with the golf ball 14, direct the golf ball 14 toward the target area, and achieve a desired flight of the golf ball 14. This disclosure assists the golfer 10 in properly setting their alignment, which in turn leads to a more proper golf swing, better contact with the golf ball 14, and achieving a desired ball flight.

The golf club 12 includes a grip 18 where the golfer's hands typically grip the golf club 12, a shaft 20 extending along a central axis A (e.g., FIG. 2; herein "axis"), and a club head 22 connected to the shaft 20 generally at an opposite end of the grip 18. The axis A, and in turn the shaft 20, follow a straight, non-curved line. The golf club 12 in this example is a wedge, which is a subtype of irons and is configured for use at short distances for achieving a variety of ball flights and shot types. This disclosure extends to other types of golf clubs, such as woods, hybrids, and irons, and is not limited to wedges.

Figure 2:
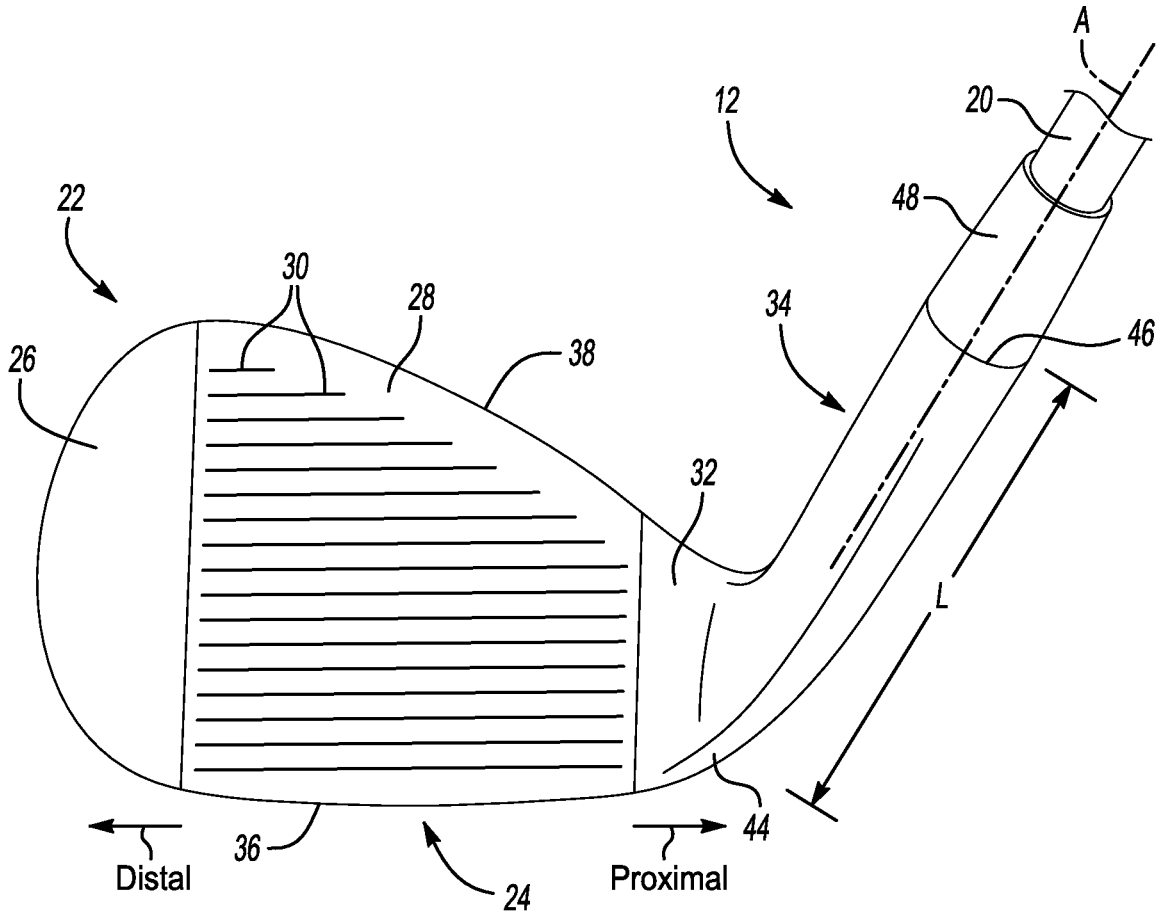
FIG. 2 is a front view of a club head.
Figure 3:
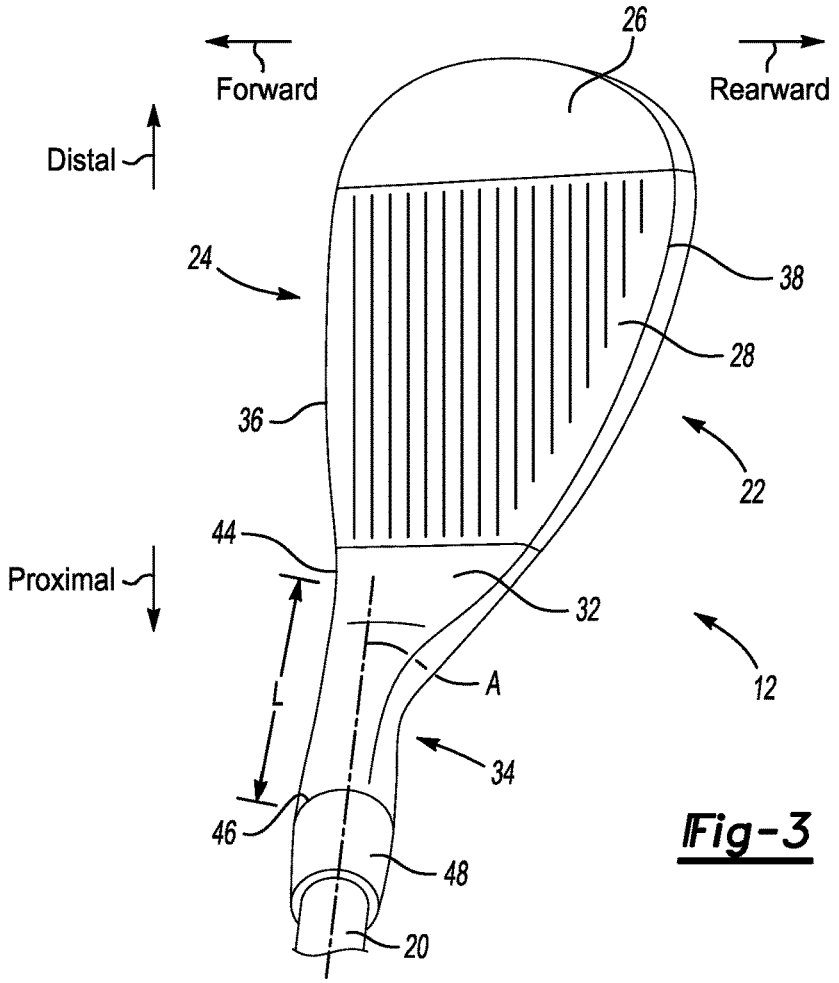
FIG. 3 is a top view of the club head.

FIGS. 2 and 3 illustrate the club head 22 in more detail. The club head 22 may be formed as a single, integral piece of material using a technique such as forging. The club head 22 may be formed using other techniques, however. The club head 22 includes a club face 24 which is configured to strike the golf ball 14. At a distal (i.e., away from the shaft 20, and in turn the golfer 10) part of the club face 24, the club face 24 includes a toe section 26 (i.e., the "toe"). Moving proximally (i.e., toward the shaft 20, and in turn the golfer 10), the club face 24 includes a central, grooved section 28 with a plurality of grooves 30, and a heel section 32 (i.e., the "heel"). The "distal" and "proximal" directions are labeled in some figures for ease of reference. Further, in some embodiments, especially when the golf club 12 is a wedge, the toe and heel sections 26, 32 can include grooves. In other embodiments, such as when the golf club 12 is a wood or hybrid, the club face 24 does not include grooves, or includes a different arrangement of grooves than what is shown in FIGS. 2 and 3.

The heel section 32 is connected directly to a hosel 34, which is proximal to the heel section 32 and connects the club head 22 to the shaft 20. The hosel 34 will be described in more detail below. With particular reference to FIG. 3, the club face 24 extends in the forward and rearward directions between a leading edge 36 at a forward-most location of the club face 24 and a top edge 38 at a rearward-most location of the club face 24. The leading edge 36 is parallel to the axis A in this example. In other examples, the leading edge 36 may be slightly curved, but is still substantially parallel to the axis A. In still other examples, a line tangent to the forward-most point of the leading edge 36 is parallel or substantially parallel to the axis A.

Figure 4:
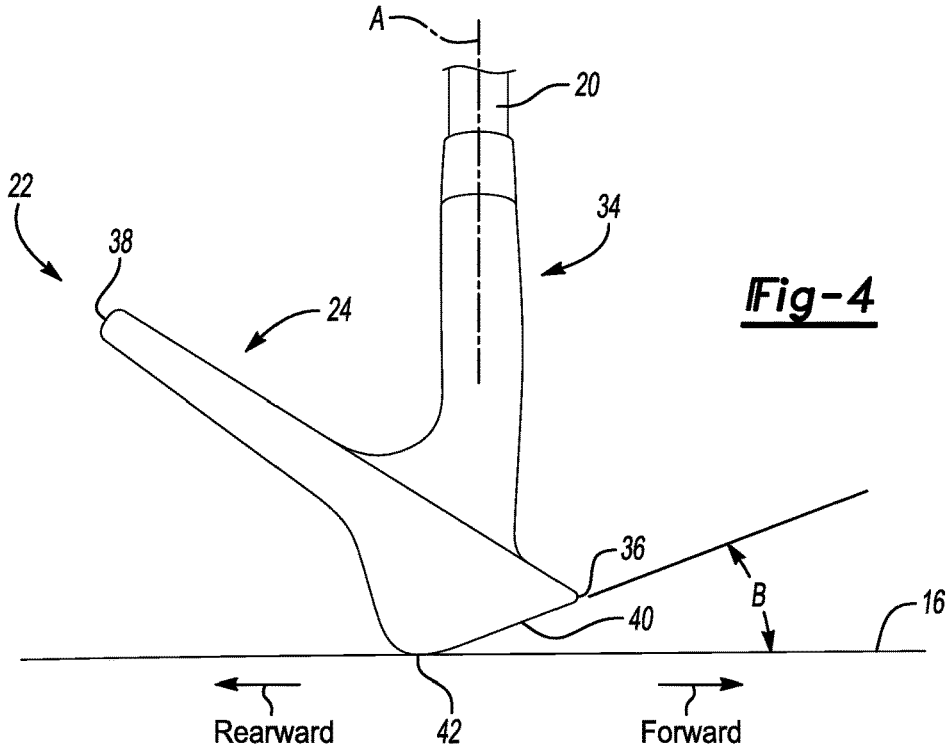
FIG. 4 is an end view of the club head relative to a ground surface.

With reference to FIG. 4, adjacent a bottom of the golf club 12, the club head 22 includes a sole 40 extending between the leading edge 36 and a trailing edge 42. Again, in this example, the golf club 12 is a wedge. As such, the sole 40 and trailing edge 42 are configured such that, when the trailing edge 42 contacts the ground surface 16 and the shaft 20 is in a neutral position where the axis A is normal to the ground surface 16, the sole 40 is inclined at an angle B, which is sometimes referred to as a bounce angle or simply the "bounce" of the golf club 12. In this position, the leading edge 36 is spaced-apart vertically upward of the ground surface 16, which is useful when the golfer 10 is attempting to hit various shot types. In particular, this arrangement reduces the likelihood that the leading edge 36 will dig into the ground surface 16.

With reference back to FIGS. 2 and 3, the hosel 34 has a length L between a first end 44 and a second end 46, which spaced-apart from the first end 44 along the axis A. The length L is parallel to the axis A of the shaft 20. The hosel 34 is centered around the axis A in this example. The hosel 34 is circular in cross-section, and in some examples the hosel 34 is substantially cylindrical along the length L. The hosel 34 is hollow and provides a socket for receiving an end of the shaft 20. Specifically, at the second end 46, the hosel 34 includes an opening into a socket within the hosel 34. The shaft 20 is connected to the hosel 34 via a relatively strong adhesive or other bonding agent such as epoxy. In other examples, a fastener, such as a screw, is used to connect the shaft 20 to the hosel 34. Such fasteners are known in golf clubs with adjustable club heads.

The golf club 12 also includes a ferrule 48, or band, which is in contact with the hosel 34 at the second end 46 and surrounds the shaft 20. A ferrule 48 is not required in all examples.

When a golfer 10 sets up to hit a golf ball 14, as in FIG. 1, the golfer 10 can see the top (i.e., side opposite ground surface 16) of the club head 22. Essentially, at setup, the view of the club head 22 from the perspective of the golfer 10 is similar to that of FIG. 3. In this disclosure, an alignment aid is provided on the golf club 12 such that it is visible to the golfer 10 as the golfer 10 sets up to hit the golf ball 14.

Figure 5:
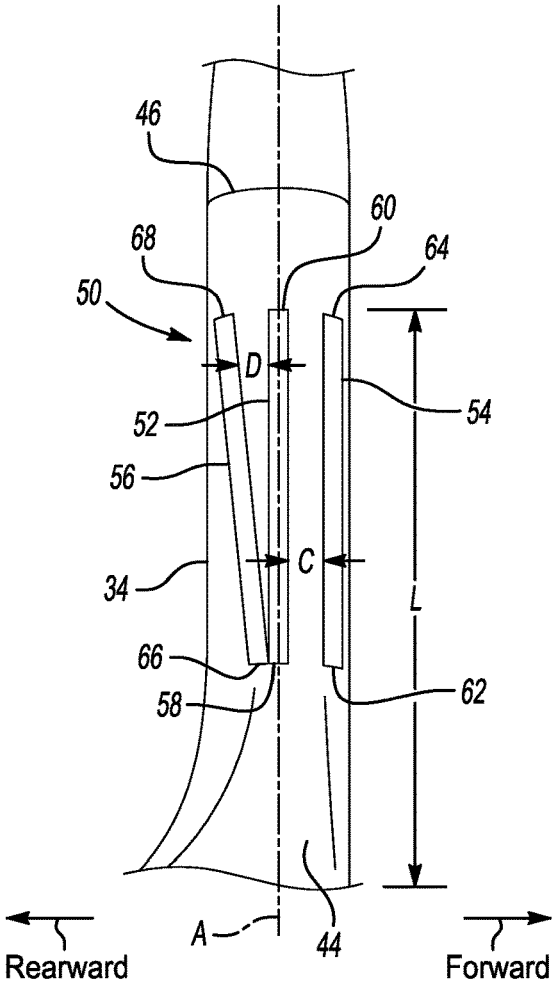
FIG. 5 illustrates a first example alignment aid relative to a portion of the golf club.

FIG. 5 illustrates a first example alignment aid 50. In FIG. 5, the alignment aid 50 is provided on the hosel 34. The alignment aid 50, in this example, includes one or more markings, each of which is configured to be used by the golfer 10 to achieve a particular alignment. In this disclosure, the term "marking" refers to a mark or series of marks.

In the example of FIG. 5, the alignment aid 50 includes a first marking 52, a second marking 54, and a third marking 56. Each of the markings 52, 54, 56 is arranged on the hosel 34 such that the golfer 10 can view the markings 52, 54, 56 and align himself or herself using a particular one of the markings 52, 54, 56. As will be explained below, each of the markings 52, 54, 56 is configured to be used by the golfer to achieve an alignment conducive to hitting a different type of golf shot. While three markings 52, 54, 56 are illustrated in FIG. 5, the alignment aid 50 could include one or more markings. Further, terms such as "first," "second," and "third" are not intended to be limiting. As an example, if the golf club 12 includes only two markings, such as the first marking 52 and the third marking 56, the third marking 56 could be referred to as a "second" marking.

The first marking 52 extends along a length between a first end 58 adjacent the first end 44 of the hosel 34 and a second end 60 adjacent the second end 46 of the hosel 34. In this example, the length of the first marking 52 extends over a majority of the length L of the hosel 34. The length of the first marking 52 may extend between 20% and 100% of the length L. The first marking 52 extends along a straight line parallel to the axis A and parallel to the leading edge 36.

The second marking 54 is extends along a straight line between a first end 62 adjacent the first end 44 of the hosel 34 and a second end 64 adjacent the second end 46 of the hosel 34. Specifically, the second marking 54 extends along a straight line parallel to the first marking 52 and having the same or substantially the same length as the first marking 52. In this example, the second marking 54 is spaced-apart circumferentially in the forward direction from the first marking 52 by a circumferential arc length C corresponding to an angle of rotation about the axis A within a range between 35 to 45 degrees. In a particular example, the second marking 54 is circumferentially spaced-apart from the first marking 52 by an angle within a range of 35 to 42 degrees. In a more particular example, the second marking 54 is circumferentially spaced-apart from the first marking 52 by an angle of 40 degrees.

The third marking 56, in this example, is non-parallel to the first and second markings 52, 54. In particular, when viewed face-on, the third marking 56 extends along a straight line between a first end 66 adjacent the first end 44 of the hosel 34 and a second end 68 adjacent the second end 46 of the hosel 34. The third marking 56 has the same or substantially the same length as the first and second markings 52, 54. The first end 66 of the third marking 56 is relatively close to the first end 58 of the first marking 52. In some examples, the first end 66 is provided at the same point as the first end 58. Moving from the first end 66 to the second end 68, the third marking 56 diverges, and specifically moves gradually more rearward, from the first marking 52. Specifically, the third marking 56 is inclined rearwardly relative to the first marking 52 by an angle D. The angle D, in one example, is an acute angle. In a particular example, the angle D is between 5 and 15 degrees. In a particular example, the angle D is 10 degrees. While in this example the third marking 56 is provided by a straight line, in other examples the third marking 56 may have a slight curvature such that it appears straight when applied to the curved hosel 34. As is readily apparent from at least FIG. 5, the entirety of the third marking 56 is rearward of a central plane containing the axis A and extending parallel to the leading edge 36 (FIG. 4). The central plane extends in-and-out of the page with reference to FIGS. 4 and 5. Specifically, the central plane extends parallel to a tangent line of a forward-most location of the leading edge 36, and also extends perpendicular to a target as well as the forward and rearward directions.

The first ends 58, 62, 66 of the markings 52, 54, 56 may be provided at a common axial location along the length L of the hosel 34, in an example. Further, in that example, the second ends 60, 64, 68 of the markings 52, 54, 56 are provided at a common axial location along the length of the hosel 34. In other words, from the perspective of the golfer 10, the markings 52, 54, 56 begin and end at the same locations along the hosel 34.

The first, second, and third markings 52, 54, 56 may be machined into the club head 22. In particular, the first, second, and third markings 52, 54, 56 may be machined, such as by milling or laser etching, into the hosel 34 after the club head 22 is substantially formed. Alternatively, the first, second, and third markings 52, 54, 56 may be integrally formed with the club head 22 as the club head is forged or cast, as examples. The first, second, and third markings 52, 54, 56 may be recessed inward of the remainder of the outer surface of the hosel 34. Those recesses could be filled, with paint or other filler, such that the first, second, and third markings 52, 54, 56 sit flush or substantially flush with a remainder of the hosel 34. The first, second, and third markings 52, 54, 56, could be applied to the golf club 12 in another manner, such as by painting, or by a sticker. The first, second, and third markings 52, 54, 56 may be visually distinguishable from one another. In a particular example, the first, second, and third markings 52, 54, 56 may be colored differently.

Figure 6:
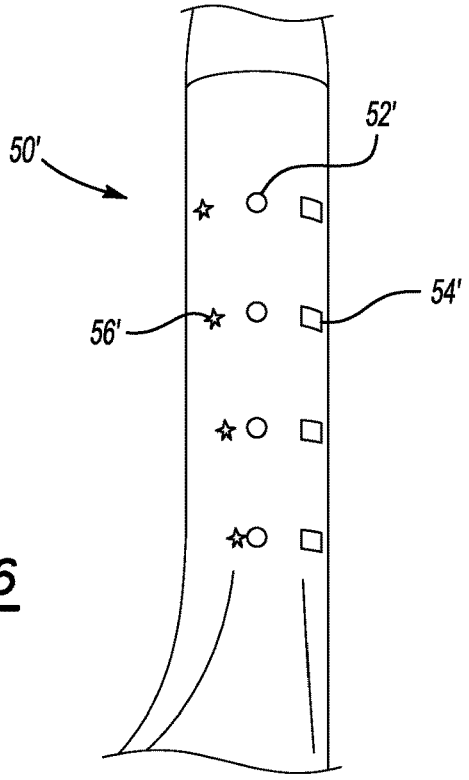
FIG. 6 illustrates a second example alignment aid relative to a portion of the golf club.

In FIG. 5, the alignment aid 50 includes first, second, and third markings 52, 54, 56 provided by continuous (i.e., unbroken) straight lines between their respective ends. In other words, each marking 52, 54, 56 is provided by a single, elongated mark. However, the markings 52, 54, 56 do not need to be provided by continuous lines, and could instead be provided by a series of marks. Further, the markings do not need to be provided by straight lines, and could be provided by one or more types of symbols or shapes. FIG. 6, for example, illustrates another example alignment aid 50' in which the first, second, and third markings 52', 54', 56' are each provided by a series of distinct marks. The first marking 52' is oriented substantially similar to the first marking 52, except the first marking 52' is provided by a series of circular marks. The second marking 54' is oriented substantially similar to the second marking 54', and except the second marking 54' is provided by a series of square marks. The third marking 56' is oriented substantially similar to the third marking 56 except the third marking 56' is provided by a series of star-shaped marks. While circles, squares, and stars are shown, the marks could be provided by different shapes or symbols.

As above, the marks providing the first, second, and third markings 52', 54', 56' may be machined into the club head 22, formed with the club head 22, or applied via a sticker or paint, as examples. Further, while the marks are differently-shaped between the first, second, and third markings 52', 54', 56', the marks could be shaped similarly (e.g., all the marks could be circles). Further, and especially when the marks are shaped similarly, the marks associated with the first, second, and third markings 52', 54', 56' could be colored differently from one another to assist the golfer 10 with visually differentiating the markings. While two example alignment aids 50, 50' are shown in FIGS. 5 and 6, this disclosure extends to other examples.

An example method of using the golf club 12 with the alignment aid 50 will now be described relative to FIGS. 7-12. While the alignment aid 50 is shown in FIGS. 7-12, a golf club having the alignment aid 50' would be used substantially similarly. FIGS. 1-6 will also be referenced below. In FIGS. 7-12, the particular marking 52, 54, 56 being used by the golfer 10 is shaded-in for ease of reference.

Figure 7:
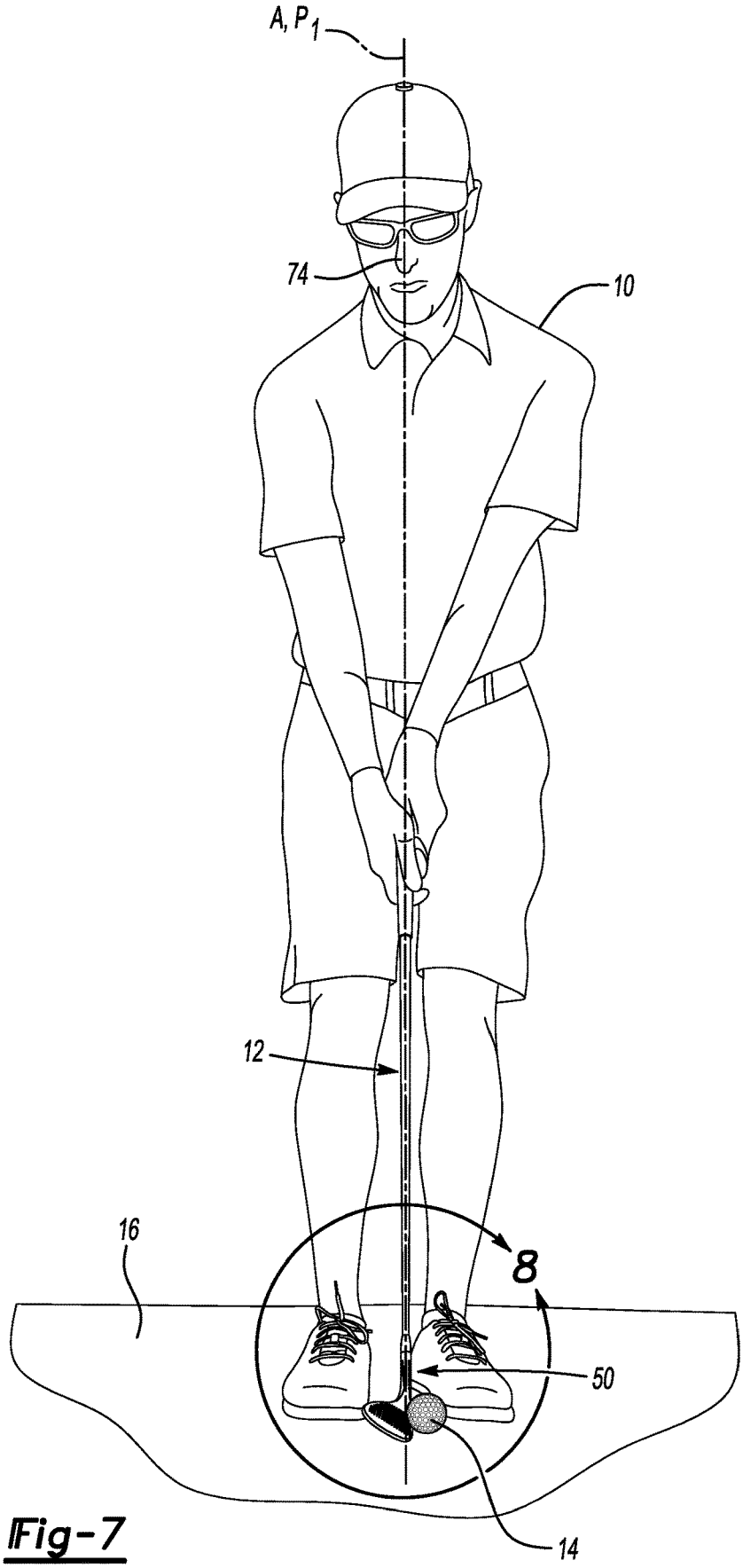
FIG. 7 is a face-on view of the golfer using the alignment aid to achieve a first alignment. The first alignment is conducive to hitting a pitch shot.

FIG. 7 is a face-on view of the golfer 10 using the golf club 12 which includes the alignment aid 50. In FIG. 7, the golfer 10 is using the alignment aid 50 to assist himself in achieving an alignment conducive to hitting a pitch shot. A pitch shot is a golf shot in which the golfer 10 attempts to hit the golf ball 14 relatively high toward a target area, such as the green, and in particular in which the golf ball 14 flies further in the air than it rolls on the ground surface 16 after landing.

Figure 8:
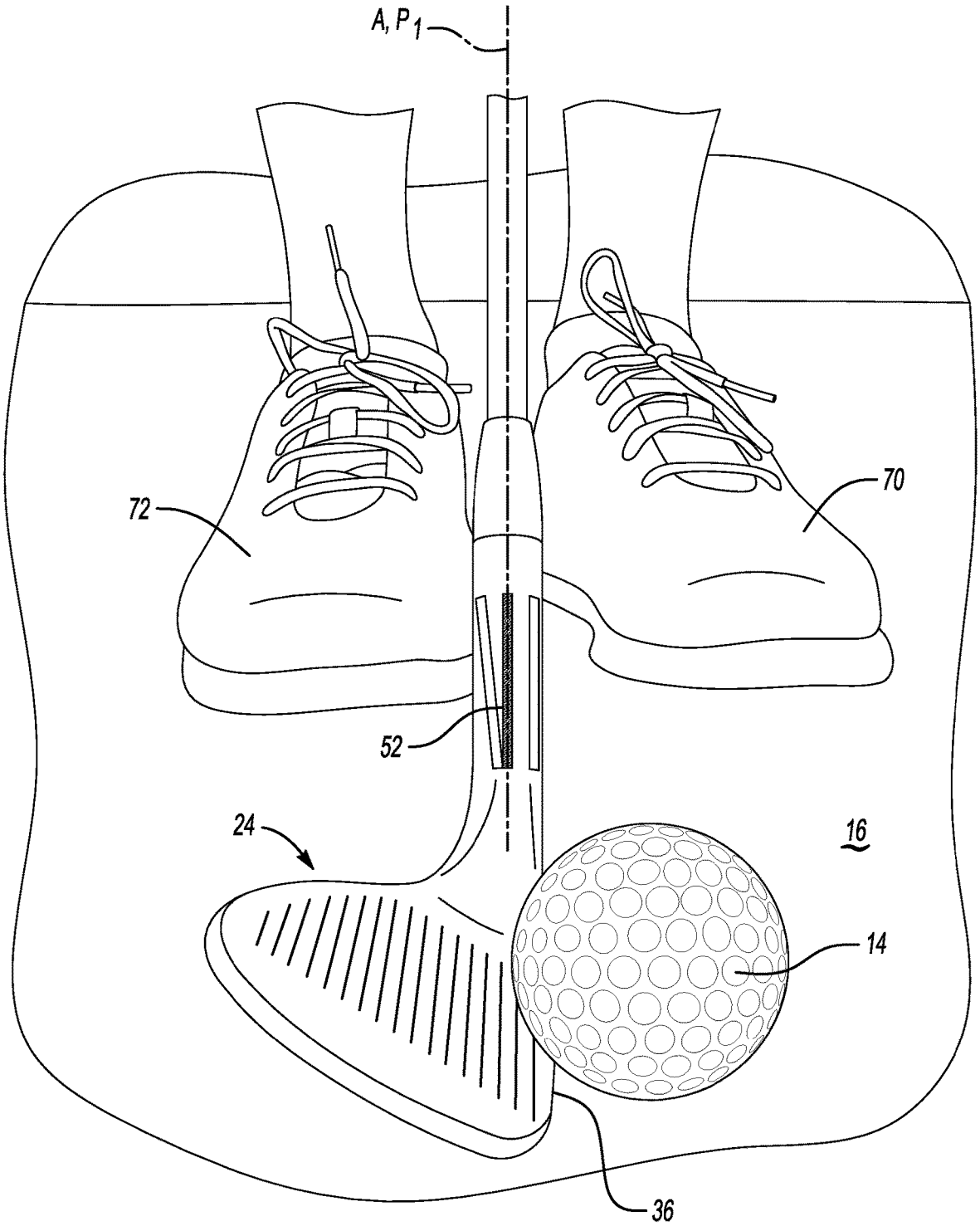
FIG. 8 is a close-up view of the encircled area of FIG. 7.

As shown in FIG. 8, the golfer 10 has aligned the golf club 12 such that the axis A is substantially normal to the ground surface 16, and the leading edge 36 is extending substantially normal to a target area, which means the club face 24 is "square" to the target area. Further, the golfer 10 is aligned such that the golf ball 14 is between his forward and trail feet 70, 72. The golfer 10 is also aligned such that, when viewed face-on, a plane $P_1$ normal to the ground surface 16 contains the entire first marking 52 and the entire axis A. The plane $P_1$ also passes through the nose 74 of the golfer 10. Further, the plane $P_1$ extends in-and-out of the page relative to FIGS. 7 and 8.

When aligned as in FIGS. 7 and 8, the golf club 12 is arranged such that a desirable angle B, namely the bounce angle, is achieved, which reduces the likelihood that the leading edge 36 will dig into the ground surface 16 during a golf shot. Without the alignment aid 50, the golfer 10 may have unintentionally positioned the golf club 12 such that the angle B is reduced by virtue of the grip 18 and shaft 20 of the golf club 12 leaning too far in the forward direction, which is a condition referred to as forward shaft lean, for a pitch shot. Many golfers struggle from excess forward shaft lean when attempting to hit a pitch shot. In addition to reducing the angle B, forward shaft lean also de-lofts the golf club 12, reducing the effective loft angle between the club face 24 and the ground surface 16, which may cause the ball to fly lower through the air and roll further along the ground surface 16 once it lands than the golfer 10 had intended. In general, the first marking 52 allows the golfer 10 to achieve an alignment conducive to hitting more consistent pitch shots.

Figure 9:
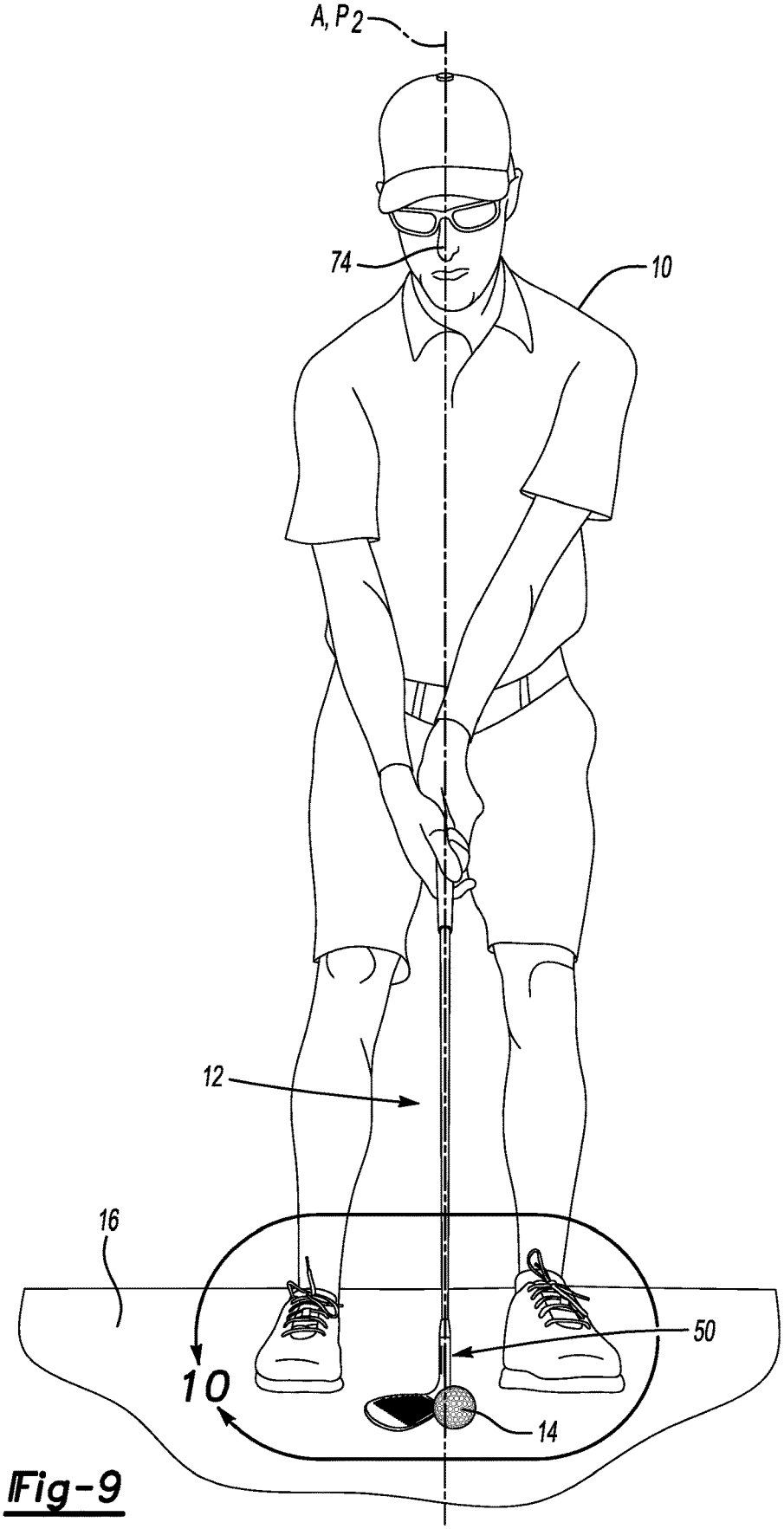
FIG. 9 is a face-on view of the golfer using the alignment aid to achieve a second alignment. The second alignment is conducive to hitting a bunker shot.

In FIG. 9, the golfer 10 is using the alignment aid 50 to assist himself in achieving an alignment conducive to hitting a bunker shot, such as a greenside bunker shot. A bunker shot is a shot in which the golf ball 14 is hit out of a bunker so that the golf ball 14 can escape the bunker and land on the target area. For most greenside bunker shots, it is desirable to hit the golf ball 14 out of the bunker on a high, arcing trajectory (i.e., steeply up and steeply down) such that when the golf ball 14 lands on the green it stops relatively quickly with little roll. FIG. 9 is also representative of an alignment of the golfer 10 when the golfer 10 is attempting to hit a flop shot, sometimes called a lob shot.

Figure 10:
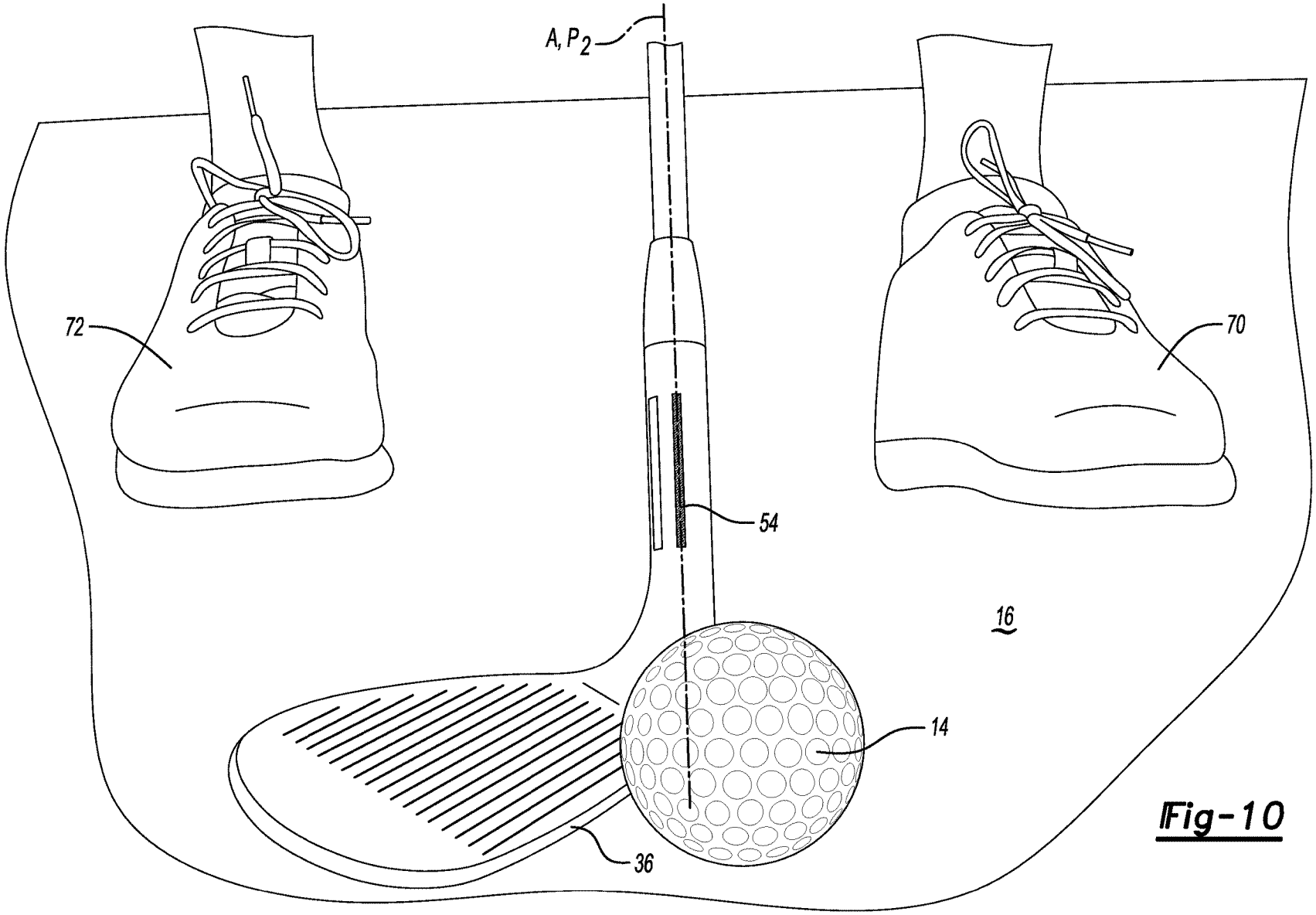
FIG. 10 is a close-up view of the encircled area of FIG. 9.

As shown in FIG. 10, the golfer 10 has aligned the golf club 12 such that, when viewed from face-on, the axis A is substantially normal to the ground surface 16 which, in the example of a bunker shot, is sand. Further, the golfer 10 is aligned such that the golf ball 14 is between his forward and trail feet 70, 72. The golfer 10 is also aligned such that, when viewed face-on, a plane $P_2$ normal to the ground surface 16 contains the entire second marking 54 and the entire axis A. The plane $P_2$ passes through the nose 74 of the golfer 10 (FIG. 9). Further, the plane $P_2$ extends in-and-out of the page relative to FIGS. 9 and 10. Whereas in FIGS. 7 and 8 the leading edge 36 was square to the target area, in FIGS. 9 and 10 the leading edge 36 gradually diverges rearwardly from the plane $P_2$ when moving distally along the leading edge 36, meaning the club face 24 is "open" to the target area. With such an alignment, the effective loft angle between the club face 24 and the ground surface 16 is increased. As such, the golfer 10 can strike the golf ball 14 such that it exhibits a high, arcing trajectory. The second marking 54 is arranged such that the effective loft angle is increased by an amount that is greater than, and in some instances significantly greater than, the amount that some golfers would have otherwise achieved. The second marking 54 thus assists some golfers with achieving a proper, and more consistent, setup for a bunker or flop shot than what would otherwise have been intuitive for those golfers.

Figure 11:
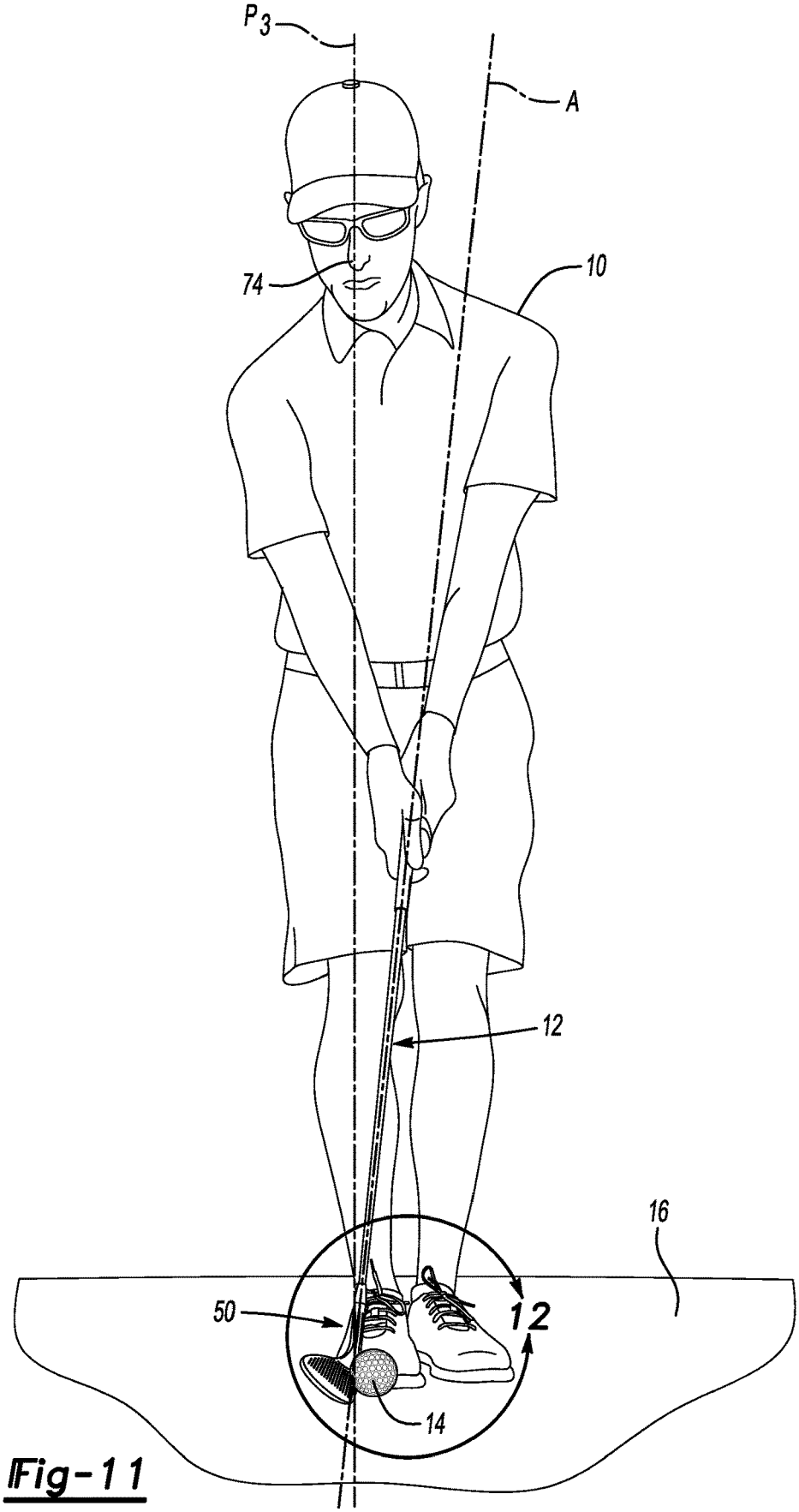
FIG. 11 is a face-on view of the golfer using the alignment aid to achieve a third alignment. The third alignment is conducive to hitting a chip shot.

In FIG. 11, the golfer 10 is using the alignment aid 50 to assist himself in achieving an alignment conducive to hitting a chip shot, which is sometimes called a bump and run shot. A chip shot is a shot in which the golf ball 14 is hit such that it rolls on the ground surface 16 further than it flies in the air.

Figure 12:
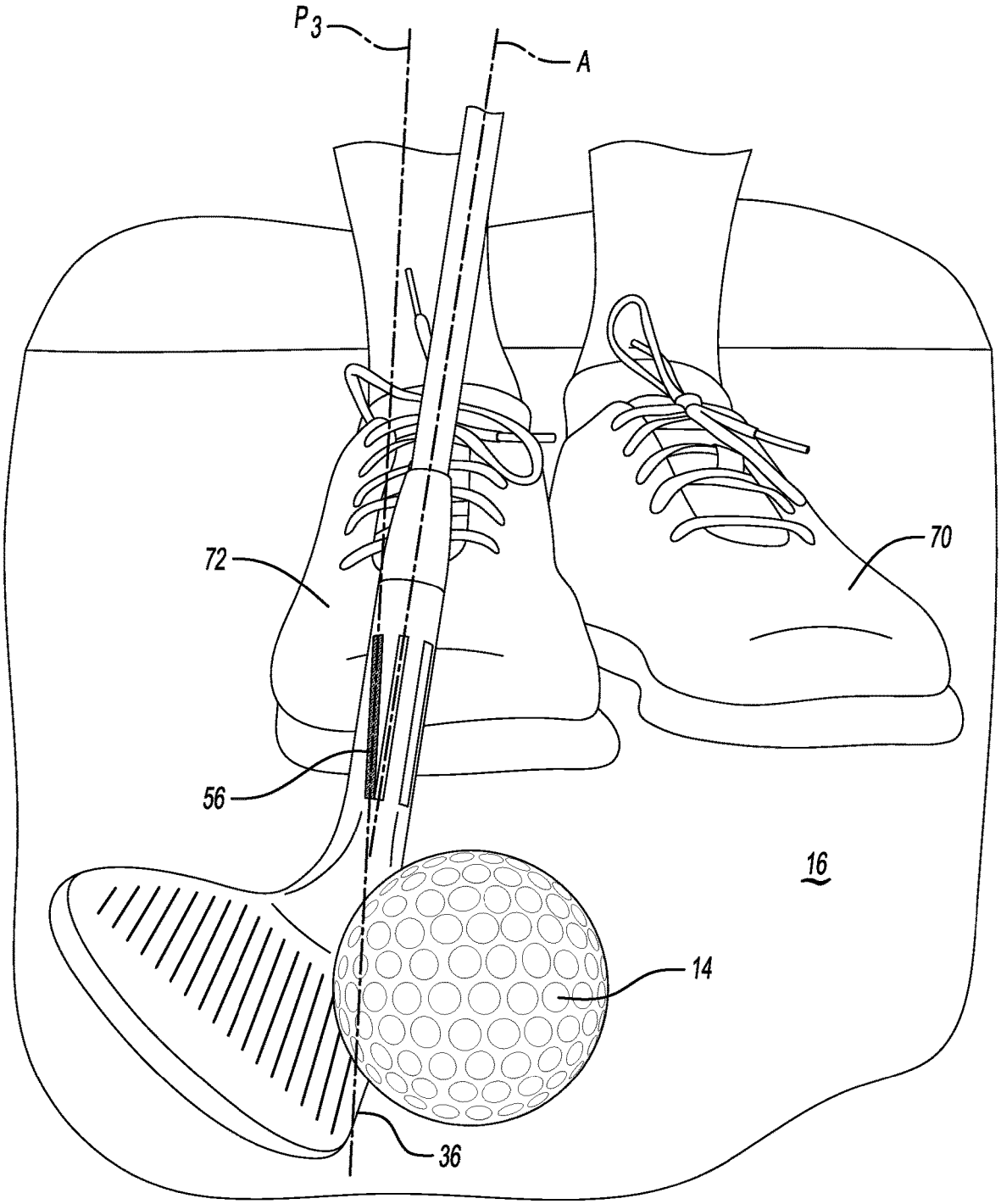
FIG. 12 is a close-up view of the encircled area of FIG. 11.

As shown in FIG. 12, the golfer 10 is aligned such that the golf ball 14 is closer to his trail foot 72 than the lead foot 74. As such, the axis A is inclined at a non-zero angle relative to a plane normal to the ground surface 16. Further, golfer 10 is aligned such that, when viewed face-on, a plane $P_3$ contains the entire third marking 56 and passes through the nose 74 of the golfer 10. Further, the plane $P_3$ extends in-and-out of the page relative to FIGS. 11 and 12. The plane $P_3$ does not contain the entire axis A. Rather, the plane $P_3$ and the axis A are transverse to one another and intersect adjacent the first end 66 of the third marking 56. In FIGS. 11 and 12, the leading edge 36 is square to the target, as in FIGS. 7 and 8, and the effective loft angle between the club face 24 and the ground surface 16 is decreased by an amount equal to the angle D between the first marking 52 and the third marking 56. As such, the golfer 10 is aligned in a manner conducive to hitting a chip shot without dramatically reducing the angle B. As such, the golfer 10 can achieve a proper, and consistent setup for chip shots, which assists the golfer in striking the golf ball 14 such that it exhibits a low trajectory without digging the leading edge 36 into the ground surface 16.

The golfer 10 may be instructed on how to use the alignment aid 50 by a golf instructor or an instructional guide, such as a video or written tutorial. In particular, the golfer 10 may be told to position the golf ball 14 in a particular location relative to his feet when using one of the markings 52, 54, 56. When using the alignment aid 50, the golfer 10 may also be told to feel as if a plane containing one of the markings 52, 54, 56 passes through their nose or the center of their chest, as examples. In this regard, while in FIGS. 7-12 the planes $P_1$, $P_2$, $P_3$ pass through the nose 74 of the golfer 10, the golfer 10 could use the alignment aid 50 to achieve alignments in which planes $P_1$, $P_2$, $P_3$ pass through a center of the chest of the golfer 10 as an alternative to or in addition to the nose 74 of the golfer 10.

The alignment aid 50 may be used by golf instructors as a teaching tool when giving golf lessons, for example. Further, a golfer 10 may use the alignment aid 50 during practice on a driving range or a practice area, or while playing golf on a golf course. An alignment aid 50 may be provided on every club in a golfer's golf bag. Alternatively, the alignment aid 50 is only provided on some clubs, such as the wedges in a golfer's golf bag. Further, some golf clubs may have different alignment aids. For instance, while a wedge may have an alignment aid with three distinct markings, a driver or iron may have an alignment aid with only one marking. Further still, the markings on the alignment aid may be standardized, such that they broadly apply to most golfers, or the markings could be customized based on the preferences of a particular golfer.

While above the alignment aid 50 is described as being machined-into or formed with the hosel 34 of the club head 22, the alignment aid 50 could be provided, partially or entirely, on the ferrule 48 and/or the heel section 32. Further, as mentioned above, the alignment aid 50 could be provided by a sticker including the markings. In that example, the sticker may be wrapped around a traditional hosel 34. The sticker may be transparent with the exception of the markings, in some examples.

The alignment aid described herein assists golfers align themselves in a manner conducive to hitting various different shot types (e.g., pitch, bunker, flop, and chip shots). The alignment aid also helps golfers achieve greater consistency in their setup positions with all types of golf clubs, leading to more consistent golf shots. Among other things, the alignment aid provides feedback to golfers regarding the orientation of various body parts at setup, such as relative hand position, head position, arm position, ball position, etc. In turn, the alignment aid provides golfers with confidence that they are achieving a consistent and/or desired alignment, and ultimately such that they are properly aligned to increase their chances of hitting a particular type of golf shot.

Figure 13:
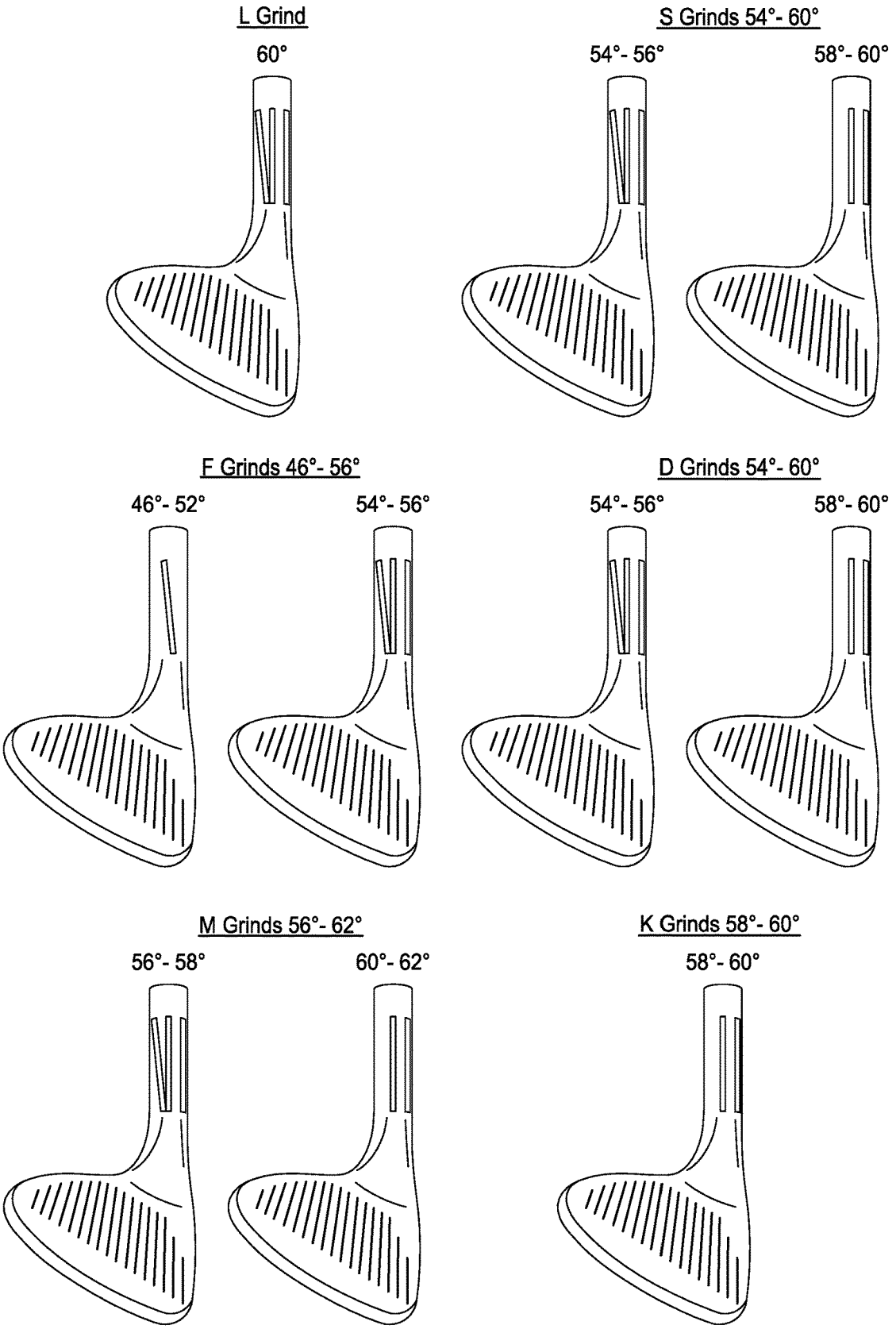
FIG. 13 illustrates a plurality of embodiments of the alignment aid, and in particular illustrates different variations of the alignment aid relative to wedges having different bounces, lofts, and/or grinds.

As mentioned above, this disclosure is not limited to the particular alignment aid illustrated in FIG. 5, for example. Indeed, this disclosure extends to alignment aids with a different number and/or arrangement of markings. For instance, the alignment aid of this disclosure can be modified such that it is particularly suited for a particular type of wedge. Wedges are versatile golf clubs and, depending on a number of factors such as loft, bounce, and grind, a particular type of wedge may be more suited for hitting certain types of shots than others. FIG. 13 illustrates a plurality of embodiments of the alignment aid, and in particular illustrates different variations of the alignment aid as applied to different types of wedges, each having different lofts, bounces, and/or grinds. The embodiments of the alignment aid in FIG. 13 are intended to provide a wedge that is suited to hitting a particular type of shot with an alignment aid having a marking that allows a golfer to properly set up to hit that shot.

FIG. 13 includes six headings labeled by grind category. The grind categories mentioned herein are those advertised and marketed on Vokey wedges, sold commercially by The Acushnet Holdings Company under their Titleist brand. Vokey grinds are referenced herein because they are well known in the golfing industry. However, Vokey grinds are mentioned only for ease of reference and explanation of the various embodiments of the alignment aid. This disclosure is not limited to use with Vokey wedges or Vokey grinds.

In general, wedge grind is the manipulation and/or removal of material from the sole of the club. Certain types of grinds make a wedge better suited for some conditions than others, and enable a golfer to hit certain shots more easily than others. Example alignment aids will be discussed with reference to the particular headings, grouped by Vokey grind type, in FIG. 13.

L Grind. An L Grind wedge is defined and advertised by Vokey as a low bounce grind providing heel, toe, and trailing edge relief to allow for maximum greenside versatility. The L Grind is advertised as being suited for firm conditions and designed for precise golfers looking for maximum shot-making versatility. In the example shown, the wedge has an L Grind and exhibits 60 degrees of loft. Further, the wedge includes an alignment aid that exhibits all three markings 52, 54, 56 shown in FIG. 5 (the markings of the alignment aid are shown, but not labeled in FIG. 13). Specifically, the wedge includes markings that can be used for hitting a standard pitch shot, a bunker shot, and a chip shot, respectively. In this example, while a wedge having 60 degrees of loft is typically not used for chip shots, the L Grind is designed for advanced and/or highly skilled golfers who may feel comfortable hitting chip shots with a high lofted wedge.

F Grind. The F Grind is defined and advertised by Vokey as an all-purpose grind that is particularly suited for full shots and shots hit with a square face. In FIG. 13, two wedges are shown under the F Grind heading. The first (left-hand) wedge exhibits between 46-52 degrees of loft and includes a single marking, similar to the marking 52. In this example, however, the marking may be inclined slightly rearwardly relative to the marking 52, such that when a golfer sets up such that the marking passes through their nose (in the manner discussed above) the shaft of the wedge will lean slightly forward. A golfer will not typically attempt to hit a chip shot or a bunker shot with a low-lofted, F Grind wedge. Thus, in this example, the alignment aid includes only a single marking. In the second wedge (the right-hand wedge), the wedge exhibits between 54-56 degrees of loft and includes three markings, substantially similar to the markings 52, 54, 56, with the exception of the marking 54. In this example, the marking 54 is circumferentially spaced-apart from the marking 52 by an angle slightly less than the angle A discussed above. Since the F Grind is suited for square-faced shots, a golfer will not typically use an F Grind wedge to open the face and attempt to hit as high of a bunker shot or a flop shot as that corresponding to the marking 54 in FIG. 5.

M Grind. The M grind is advertised by Vokey as being designed for golfers that like to rotate the club face open and closed to hit various types of shots around the green, and for golfers with a shallower, more sweeping swing type who play shots from a variety of clubface positions. There are two wedges illustrated under the M Grind heading. The first, left-hand wedge exhibits a loft between 56-58 degrees and exhibits the three markings 52, 54, 56. The second, right-hand wedge exhibits a higher loft between 60-62 degrees and only exhibits the markings 52, 54, since the higher lofted wedge with the M Grind is less suited for chip shots. The right-hand wedge could include another line forward of the marking 52, either between the markings 52, 54 or forward of the marking 54, to be utilized for hitting shots lower or higher than those corresponding to the marking 54, respectively.

S Grind. The S Grind is defined and advertised by Vokey as being suited for square faced shots with slightly more versatility than the F grind. Two wedges are shown in FIG. 13 under the S Grind heading. In the left-hand wedge, which exhibits between 54-56 degrees of loft, all three markings 52, 54, 56 are present on the wedge. In the right-hand wedge, which exhibits between 58-60 degrees of loft, only the markings 52, 54 are present as the higher-lofted club with the S Grind is not particularly suited for chip shots.

D Grind. The D grind is advertised by Vokey as providing a high, measured bounce and being suited for golfers with a steeper angle of attack who play shots from a variety of clubface positions. The first, left-hand wedge exhibits a loft between 54-56 degrees and exhibits all three markings 52, 54, 56. The second, right-hand wedge exhibits a higher loft between 58-60 degrees and only exhibits the markings 52, 54, since the higher lofted wedge is less suited for chip shots. The right-hand wedge could include another line forward of the marking 52, either between the markings 52, 54 or forward of the marking 54, to be utilized for hitting shots lower or higher than those corresponding to the marking 54, respectively.

K Grind. The K Grind is advertised by Vokey as providing a wide, full sole and being forgiving in a variety of sand and turf conditions. The illustrated wedge exhibits a loft between 58-60 degrees and only exhibits the markings 52, 54, since the wedge is less suited for chip shots and is particularly suited for pitch shots and bunker shots.

Again, while a number of specific configurations of the alignment aid are shown in FIG. 13, these configurations are exemplary. This disclosure extends to other configurations of the alignment aid.

Another aspect of this disclosure relates to customization of the alignment aid. In this respect, the alignment aid could feature markings that can be used to enable a golfer to mimic the setup position of a famous golfer. For instance, with reference again to Vokey wedges, one of the most recognizable professional golfers today playing such wedges is Justin Thomas. Other examples include Jordan Spieth, Adam Scott, and Steve Stricker, among many others. The alignment aid of this disclosure could include markings that can be used by a golfer to mimic the setup position of these famous golfers for various shots. As a particular example, one could study the manner in which Justin Thomas typically sets up when hitting a bunker shot, and the alignment aid could be designed to include a marking which can be utilized by another golfer to set up in the same way. With the alignment aid configured in this manner, an amateur golfer, for example, can set up to a bunker shot and gain confidence knowing they are aligned in the same or similar manner as a famous golfer like Justin Thomas. Further, Justin Thomas himself can use the alignment aid to increase his own consistency. While a handful of famous golfers have been listed above, the alignment aid could also feature markings corresponding to the setup of other professional golfers, including touring professionals and/or teaching professionals, or famous personalities. The alignment aid could also feature markings corresponding to the manner in which one would set up to hit a specialty shot or a trick shot.

It should be understood that directional terms such as "forward," "rearward," "distal," "proximal," "axial," "radial," and "circumferential" are used above consistent with their known meanings and relative to the attitude of a golf club during normal use. Further, these terms have been used herein for purposes of explanation, and should not be considered otherwise limiting. Terms such as "generally," "substantially," and "about" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A golf club, comprising:

a shaft disposed about a central axis;

a club head;

a club face;

a hosel; and a marking on the hosel configured for use by a golfer in achieving an alignment, wherein the entirety of the marking is rearward of a central plane, wherein the central plane contains the central axis and extends parallel to a leading edge of the club face, and wherein a circumferential distance about the hosel between the marking and the central plane increases moving away from the club face.

2. The golf club as recited in claim 1, wherein the club head includes the club face and the hosel.

3. The golf club as recited in claim 1, wherein:

the marking is a first marking and the alignment is a first alignment, the golf club comprises a second marking on the hosel configured for use by a golfer in achieving a second alignment different than the first alignment.

4. The golf club as recited in claim 3, wherein the second marking is closer to the central plane than the first marking.

5. The golf club as recited in claim 4, wherein, the golf club is configured such that the when the golfer is in the first and second alignments:

the leading edge of the club face is spaced-apart above a ground surface by different, non-zero first and second distances, respectively, and the golf club exhibits different first and second effective loft angles between the club face and the ground surface, respectively.

6. The golf club as recited in claim 3, further comprising a third marking on the hosel configured for use by the golfer in achieving a third alignment different than the first and second alignments, wherein the entirety of the third marking is on an opposite side of the central plane as the first marking.

7. The golf club as recited in claim 1, wherein the marking is machined into the hosel.

8. The golf club as recited in claim 1, wherein the marking is provided by a continuous line.

9. The golf club as recited in claim 1, wherein the marking is provided by a set of marks.

10. The golf club as recited in claim 1, wherein the golf club is configured such that when the golfer is in the alignment, the leading edge of the club face is spaced-apart above a ground surface.

11. A method of instructing a golfer to use a golf club of claim 1.

12. The golf club as recited in claim 1, wherein the alignment is a setup position.

13. The golf club as recited in claim 1, wherein the central plane extends parallel to a tangent line of a forward-most location of the leading edge.

14. The golf club as recited in claim 1, wherein the central plane contains an entirety of the central axis.

15. A method of using a golf club, comprising:

before beginning a golf swing, aligning the golf club relative to a golf ball, a target, and a golfer to achieve a first alignment in which a first plane passes through a first marking on a hosel of the golf club and either a nose or a center of a chest of the golfer and in which a leading edge of the golf club is spaced-apart above a ground surface.

16. The method as recited in claim 15, further comprising:

aligning the golf club relative to a golf ball, a target, and the golfer to achieve a second alignment in which a second plane passes through a second marking on the hosel of the golf club and either the nose or the center of the chest of the golfer, wherein, in the second alignment, an effective loft angle between a club face and a ground surface is different than in the first alignment, and wherein, in the second alignment, a leading edge of the golf club is spaced-apart above a ground surface.

17. The method as recited in claim 16, further comprising:

aligning the golf club relative to the golf ball, the target, and the golfer to achieve a third alignment in which a third plane passes through a third marking on the hosel and either the nose or the center of the chest of the golfer, and wherein, in the third alignment, an effective loft angle between the club face and the ground surface is greater than in the first and second alignments, wherein, in the third alignment, a leading edge of the golf club is spaced-apart above the ground surface.

18. The method as recited in claim 15, wherein:

the entirety of the first marking is rearward of a central plane, wherein the central plane contains a central axis of a shaft of the golf club and extends parallel to a leading edge of a club face of the golf club, and wherein a circumferential distance about the hosel between the marking and the central plane increases moving away from the club face.

19. The method as recited in claim 18, wherein the central plane extends perpendicular to the target.

20. The method as recited in claim 19, wherein the central plane extends parallel to a tangent line of a forward-most location of the leading edge and contains the entirety of the central axis.

* * * * *